US008079884B2

(12) United States Patent
Stauch et al.

(10) Patent No.: US 8,079,884 B2
(45) Date of Patent: Dec. 20, 2011

(54) CLAMPING SCREW

(75) Inventors: Gert Stauch, Hof (DE); Peter Grötsch, Rehau (DE); Volker Markgraf, Röslau (DE); Jurgen Krauss, Schlegel (DE)

(73) Assignee: Nexans, Paris (FR)

( * ) Notice: Subject to any disclaimer, the term of this patent is extended or adjusted under 35 U.S.C. 154(b) by 168 days.

(21) Appl. No.: 12/505,930

(22) Filed: Jul. 20, 2009

(65) Prior Publication Data

US 2010/0112873 A1 May 6, 2010

(30) Foreign Application Priority Data

Jul. 25, 2008 (EP) ..... 08290723

(51) Int. Cl.
*H01R 4/36* (2006.01)

(52) U.S. Cl. ..... 439/810

(58) Field of Classification Search ..... 439/810–814; 411/5, 2

See application file for complete search history.

(56) References Cited

U.S. PATENT DOCUMENTS

| | | | | |
|---|---|---|---|---|
| 1,523,932 | A * | 1/1925 | Davies | 411/393 |
| 7,645,106 | B2 * | 1/2010 | Gordon | 411/393 |
| 7,699,669 | B2 * | 4/2010 | Sweeney et al. | 439/791 |

FOREIGN PATENT DOCUMENTS

| | | |
|---|---|---|
| DE | 1902067 | 7/1964 |
| DE | 10230502 | 1/2004 |

* cited by examiner

*Primary Examiner* — Xuong Chung Trans
(74) *Attorney, Agent, or Firm* — Sofer & Haroun, LLP

(57) ABSTRACT

What is specified is a clamping screw (2) for fastening an electrical conductor in a metallic terminal which is designed as a tubular piece and which in its wall has at least one through hole provided with a thread and intended for receiving the clamping screw. A rotating element (10) which can rotate about at least one axis is mounted on that end of the clamping screw (2) which serves for bearing against the electrical conductor.

3 Claims, 1 Drawing Sheet

CLAMPING SCREW

RELATED APPLICATION

This application claims the benefit of priority from European Patent Application No. 08290723.9, filed on Jul. 25, 2008, the entirety of which is incorporated by reference.

BACKGROUND

1. Field of the Invention

The invention relates to a clamping screw for fastening an electrical conductor in a metallic terminal which is designed as a tubular piece and which in its wall has at least one through hole provided with a thread and intended for receiving the clamping screw, wherein a ball is mounted in a recess at that end of the clamping screw which serves to bear against the electrical conductor (DE 1 902 067 U).

2. Description of Related Art

The contact pressure with which a clamping screw in the mounted state presses against an electrical conductor should be as large as possible and be maintained permanently so that a stable electrical connection between electrical conductors of cables, in particular of power cables, can be ensured throughout the required service life. Owing to the friction between the clamping screw and the thread of the through hole of the terminal, and owing to the friction between the end face of the clamping screw and the surface of the conductor when tightening said clamping screw, an increased force is required to turn the clamping screw. As a result, the force with which the clamping screw presses onto the conductor may be too low to achieve a permanently sufficient contact stability.

Added to this is the fact that, in the case of multi-wire conductors, the individual wires thereof rub against one another when compressed as a result of the clamping screw being tightened. This leads to a lower pressure being produced inside the conductor than on the surface thereof. That can lead to problems when connecting multi-wire conductors having a large cross section or in the case of segmental conductors, so-called "Milliken conductors". If the contact between the individual wires inside the conductor is insufficient, above-average heating occurs. In the case of conductors made of aluminium, the heating additionally leads to an increased flow of the material and consequently to a further reduction in the contact pressure after only a short time. The electrical connection between the clamping screw and conductor or between the conductor and terminal is then unusable relatively quickly.

DE 102 30 502 A1 discloses a clamping screw at whose end there is situated a clamping piece portion which is designed as a disc and which is set off all around with respect to the clamping screw by a lateral indentation to form a predetermined breaking point. During the tightening of the clamping screw, the force on its end face grows and the disk is separated from the clamping screw at the predetermined breaking point. The clamping screw can subsequently rotate relative to the disc which is then pressed, only without rotating itself, onto the conductor in the axial direction of the clamping screw. Prior to the separation, the disc is rotated together with the clamping screw and thereby moved or rotated on the conductor. This can lead to undefined damage to the conductor. Moreover, particularly in the case of multi-wire conductors having a large cross section, the relatively large-area disc does not allow a high contact pressure inside the conductor.

DE 1 902 067 U, mentioned in the beginning, describes a clamping screw designated as a pressure screw wherein a ball constituting a pressure piece is held with a limited degree of axial mobility in a recess in the end of the screw shank. The recess is of such size that the ball can be displaced therein in the axial direction of the screw shank to such an extent that it completely disappears within the profile thereof when the clamping screw is tightened for fastening to an electrical conductor. Here, said ball is moved counter to the action of a compression spring mounted in the screw shank. Therefore, when tightening the clamping screw, at first only the end face or shoulder thereof acts on the conductor. It is only when signs of fatigue appear on the conductor that the ball is pressed against the latter by the compression spring. In the case of this known clamping screw, too, the end face of the clamping screw is thus rotated further in the circumferential direction after coming into contact with the conductor, which means that damage to the conductor cannot be ruled out here either.

OBJECTS AND SUMMARY

The object on which the invention is based is to design the clamping screw described at the beginning such that damage to the conductor can be avoided when tightening said screw and such that it produces a permanently high contact pressure even, and in particular, in the case of multi-wire conductors.

This object is achieved according to the invention in that

- the clear width of the recess corresponds to the dimensions of the ball,
- the ball is arranged in the recess such that it can be rotated in all directions by being separated from its wall by a gap which ensures the mobility of said ball, and
- the ball projects in its working position beyond the end of the clamping screw.

The ball of this clamping screw projects therefrom constantly and in particular in its working position and comes only into contact with the conductor to be fastened when tightening said screw. Although the ball is mounted in the recess, which corresponds to its dimensions, such that it can be rotated in all directions, i.e. is freely rotatable, on tightening the clamping screw said ball is first of all rotated therewith, but only until it bears against the surface of the conductor. As the clamping screw is rotated further, the ball is then no longer rotated therewith but is pressed on and into the conductor in the direction of movement of the clamping screw. Any damage to the surface of the conductor by a part rotated with a force effect can therefore be ruled out. The freely rotatable ball offers a significant advantage particularly in the case of multi-wire conductors having a large cross section of 2000 $mm^2$, for example, since when using a clamping screw comprising such a ball, the individual wires inside the conductor are also acted on at the same time. It is possible in this way to achieve a very high contact pressure between the clamping screw and conductor that is maintained long term.

In order to ensure that the ball can rotate freely in the recess of the clamping screw with increased reliability, a lubricant can advantageously be applied to the surface thereof.

BRIEF DESCRIPTION OF THE DRAWINGS

An exemplary embodiment of the subject of the invention is illustrated in the drawings, in which.

DETAILED DESCRIPTION

Figure 1:
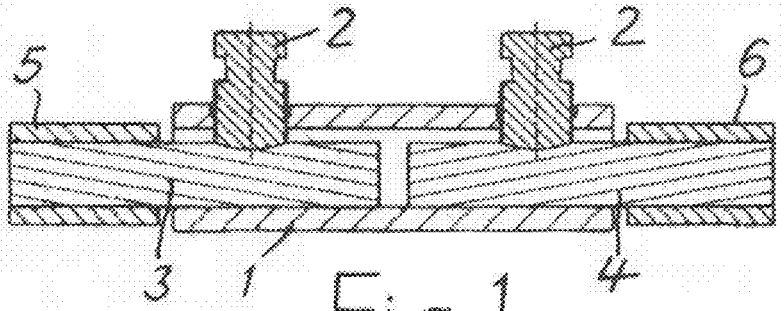
FIG. 1 schematically shows a connection point between the conductors of two cables, in section.

FIG. 1 depicts a terminal 1 which is designed as a tubular piece and which is made, for example, of a tin-plated aluminium alloy. The terminal 1 has two threaded bores in each of which is arranged a clamping screw 2 provided with an external thread. The electrical conductors 3 and 4 of two electrical cables 5 and 6, which are particularly power cables, project from two different sides into the terminal 1. In the mounted position they are secured in the terminal 1 by the clamping screws 2 and thereby connected to one another in an electrically conducting manner. In a preferred embodiment, the electrical conductors 3 and 4 are embodied as multi-wire conductors. They are made particularly of aluminium or copper. The conductors 3 and 4 can also consist of segments in which individual wires are combined.

Figure 2:
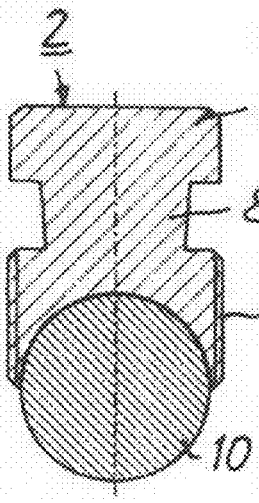
FIG. 2 shows a clamping screw according to the invention, in section.
Figure 3:
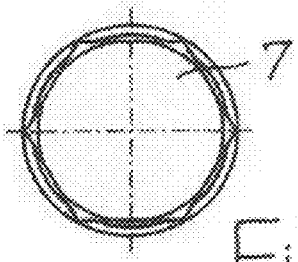
FIG. 3 shows a plan view of the clamping screw according to FIG. 2.

The clamping screw 2 according to FIGS. 2 and 3 has a screw head 7 suited for the engagement of a screwing tool, a shank 8, an external thread 9 and a ball 10 which is mounted in a recess provided at an end of the clamping screw that serves for bearing against the conductor 3 or 4. The recess is embodied, for example, as a spherical segment into which the ball 10 is snapped into place. However, it is also possible for example for the ball 10 to be held in the recess by means of an elastomer ring at least until such time as said ball comes into contact with one of the conductors 3 and 4 when tightening the clamping screw 2.

The clear width of the recess corresponds to the dimensions of the ball 10. It is advantageously slightly larger than the ball 10 such that a narrow gap remains between the ball 10 and the wall of the recess. This gap ensures that the ball 10 can move freely in the clamping screw 2 such that it can rotate in the recess relative thereto even when it is pressed against one of the conductors 3 and 4. The ball 10 is advantageously made of the same material as the conductors 3 and 4 which are to be connected, that is to say preferably of aluminium, an aluminium alloy or copper. In order to ensure that they can rotate freely in the recess of the clamping screw 2 with increased reliability, a lubricant can be advantageously applied to the surface of the ball 10. The ball 10 penetrates to a greater or lesser depth into the conductor 3 or 4 dependent on the force with which the clamping screw 2 is rotated.

Figure 4:
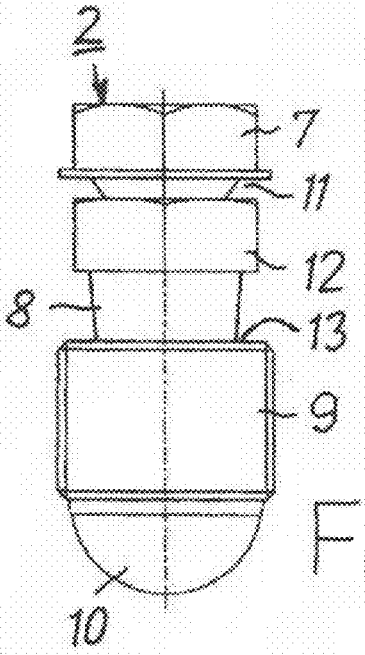
FIG. 4 shows a view of a clamping screw embodied as a shear screw.
Figure 5:
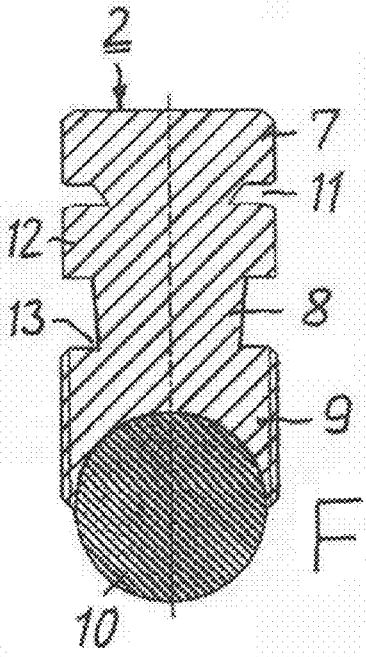
FIG. 5 shows the clamping screw according to FIG. 4, in section.

According to FIGS. 4 and 5, the clamping screw 2 can also be embodied as a shear screw with at least one shear point or predetermined breaking point arranged along the axial extent thereof. According to the representation shown in the drawing, it has a peripheral predetermined breaking point 11 and also a second screw head 12 which comes into effect when the screw head 7 is sheared off at the predetermined breaking point 11. Use can be made of a conventional spanner for tightening such a shear screw. The screw head 7 is sheared off on reaching a predetermined torque.

For the purpose of further tightening the shear screw until the desired firm fit is obtained, use is then made of the screw head 12. It is possible by means of the second screw head 12 for the clamping screw 2 to be tightened with a further increased force. On reaching a given increased torque, the second screw head 12 then also shears off, specifically at a second predetermined breaking point 13 at which the shank 8 of the clamping screw 2 merges into that part of said screw which bears the external thread 9. This variant of the clamping screw 2 can advantageously be used when it is intended to achieve a particularly uniform penetration thereof into a conductor. For that purpose, a fitter, for example using a corresponding set of fitting instructions, can first of all tighten all of the available clamping screws 2 until the first screw head 7 thereof shears off. The clamping screws 2 can then be tightened, for example in the same order as in the first screwing operation, until the second screw head 12 thereof shears off.

The screw heads 7 and 12 are designed for example as hexagon heads in a customary manner. The clamping screw 2 can then be rotated using a conventional spanner. To achieve and maintain an electrically highly conductive contact, a firm connection is required between the conductors 3 and 4 of the two cables 5 and 6 and the tubular terminal 1 into which the conductors are inserted. This can be advantageously ensured by using a so-called torque wrench which, on tightening the clamping screw 2, "slips" when a sufficiently firm fit of the latter is achieved.

The clamping screw 2 could also have a central polygonal blind hole and then be rotated by means of a pin with a polygonal cross section that fits into the blind hole.

The invention claimed is:

1. Clamping screw, for fastening an electrical conductor in a metallic terminal which is designed as a tubular piece and that has at least one through hole provided with a thread and intended for receiving the clamping screw, said clamping screw comprising:

a ball mounted in a recess at that end of the clamping screw which serves to bear against the electrical conductor, wherein the clear width of the recess corresponds to the dimensions of the ball, the ball is arranged in the recess such that said ball can be rotated in all directions by being separated from a wall of said recess by a gap which ensures the mobility of said ball, and the ball projects, in said ball's working position, beyond the end of the clamping screw.

2. Clamping screw according to claim 1, wherein the recess is a spherical segment into which the ball is snapped into place in a freely rotatable manner.

3. Clamping screw according to claim 1, wherein a lubricant is applied to the surface of the ball.

* * * * *